US005755341A

United States Patent [19]

Spamer

[11] Patent Number: 5,755,341

[45] Date of Patent: May 26, 1998

[54] DISPLAY SHELF AND METHOD OF MAKING THE SAME

[75] Inventor: William S. Spamer, Roswell, Ga.

[73] Assignee: The Mead Corporation, Dayton, Ohio

[21] Appl. No.: 752,867

[22] Filed: Nov. 20, 1996

[51] Int. Cl.[6] ..... A47B 73/00

[52] U.S. Cl. ..... 211/59.2; 211/74

[58] Field of Search ..... 211/74, 162, 59.2, 211/71, 117, 208, 209

[56] References Cited

U.S. PATENT DOCUMENTS

| | | | |
|---|---|---|---|
| 4,022,363 | 5/1977 | Eliassen | 211/74 |
| 4,228,905 | 10/1980 | Cammarota | 211/71 |
| 4,310,097 | 1/1982 | Merl | 211/59.2 |
| 4,318,485 | 3/1982 | Clement | 211/74 |
| 4,340,557 | 7/1982 | Gross | 264/146 |
| 4,367,818 | 1/1983 | Suttles . | |
| 4,401,221 | 8/1983 | Suttles | 211/74 |
| 5,160,473 | 11/1992 | Bontrager | 264/138 |
| 5,586,687 | 12/1996 | Spamer et al. | 221/298 |

OTHER PUBLICATIONS

Photographs numbered i–vi of a device manufactured by Paul Flum Creation which device was acquired by the assignee of the present invention in Oct. 1996.

Set Up Instructions for the HSB Neck Glide System dated Mar. 1996.

*Primary Examiner*—James R. Brittain
*Assistant Examiner*—Gerald A. Anderson
*Attorney, Agent, or Firm*—Tsugihiko Suzuki

[57] ABSTRACT

A display shelf comprises a back in and elongate parallel tracks arranged side by side along the lower side of the backing panel. Each track is adapted to support a row of articles such that the articles in the row are suspended from each track for movement along that track. The backing panel and the tracks are formed together as a unitary structure. A method of making the display shelf comprises forming moldable material into a unitary structure including a backing panel and parallel hollow longitudinal ribs arranged side by side along one of the opposite sides of the backing panel. Each longitudinal rib includes a pair of longitudinally extending opposed side walls interconnected by a longitudinally extending bridging wall. The method also comprises cutting a slot in the bridging wall of each longitudinal rib. The slot in each longitudinal rib extends along that rib such that a pair of spaced parallel rails along the side walls are created out of the bridging wall to receive therebetween the top portions of the articles of the row.

15 Claims, 6 Drawing Sheets

FIG. 6
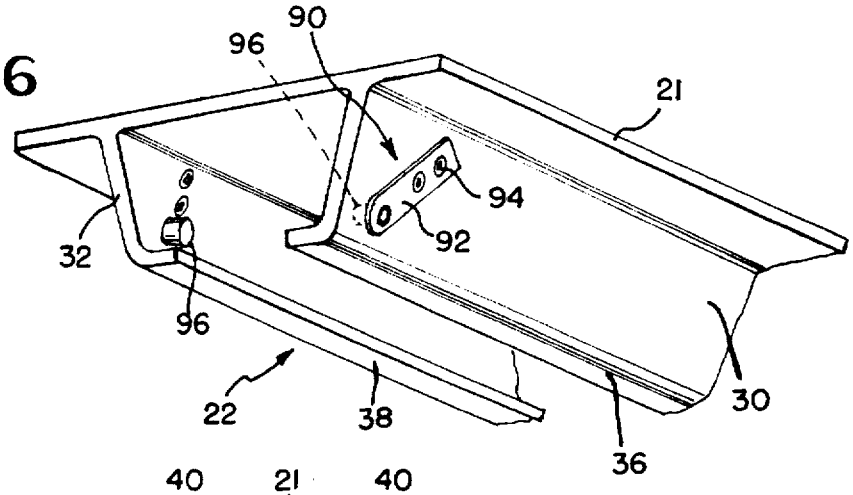
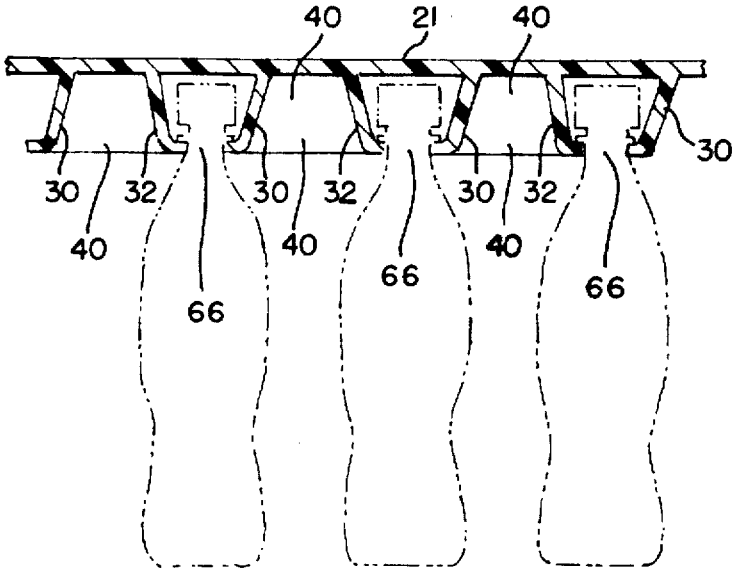
FIG. 4
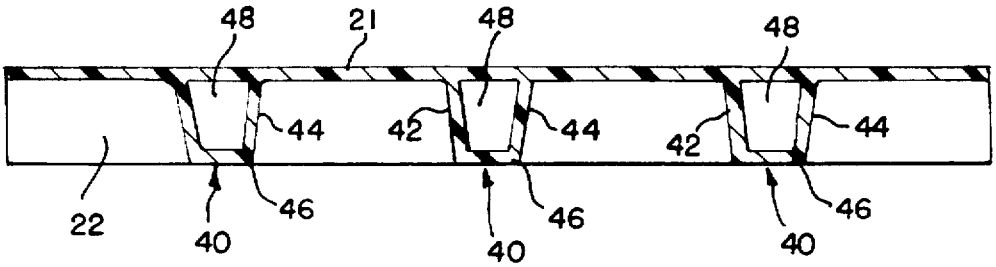
FIG. 5

DISPLAY SHELF AND METHOD OF MAKING THE SAME

BACKGROUND OF THE INVENTION

This invention relates to shelves for displaying or storing articles such as bottles, stemware or the like, and particularly to a suspension-type display shelf having a plurality of elongate parallel tracks for supporting articles in pendant position.

Suspension-type display shelves have been used in the merchandising of soft drink bottles such as PET bottles having outwardly projecting annular neck flanges. These shelves have a plurality of elongate tracks arranged side by side in a parallel relationship. Each track has a pair of spaced parallel rails extending along that track. The necks of flanged bottles are received between the rails of each track so that the bottles are engaged at their neck flanges with the rails and thus suspended from the respective track. The bottles received in each track are automatically arranged in a tidy row along that track and presented for removal by customers through the front end of the track.

Typically, each track of the shelves of the type described above is manufactured separately as a part or parts of a shelf, and several separate tracks are assembled together into the shelf. Examples of these assembled shelves are disclosed in U.S. Pat. Nos. 4,318,485; 4,367,818; and 4,401,221 which are owned by the assignee of the present invention. These shelves, on one hand, have certain adjustability in size and number of tracks. On the other hand, it is costly to separately manufacture different parts and time-consuming to assemble the separate parts into a device.

What is needed, therefore, is a suspension-type shelf which is easy to manufacture and ready to use without substantial assembling work.

SUMMARY OF THE INVENTION

The present invention provides a display shelf which comprises a backing panel and elongate parallel tracks arranged side by side along the lower side of the backing panel. Each track is designed to support a row of articles such that the articles in the row are suspended from that track for movement along the track. According to the invention, the backing panel and the tracks are molded together as a unitary structure.

In a preferred embodiment, each track comprises a pair of longitudinally extending opposed side walls joined along their upper edges to the backing panel, and a pair of parallel rails joined respectively to the side walls along their lower edges. A space is maintained between the rails of each track to receive the top portions of articles.

In a further preferred embodiment, the shelf may have transverse ribs formed integrally with the backing panel. The transverse ribs may be disposed along the backing panel transversely of the tracks such that each transverse rib extends between adjacent tracks. Each transverse rib may have a pair of transversely extending opposed side walls interconnected by a base wall so that a hollow is defined within that transverse rib. The hollows of the transverse ribs may be in fluid communication with each other through the paths each defined between the side walls of the respective track.

One preferred form of the unitary structure is a molded plastic structure and more preferably a structure molded of thermoplastic resin.

Present invention also provides a method of making the above display shelf. The method comprises a forming step and a cutting step. The forming step comprises forming moldable material into a unitary structure including a backing panel and parallel hollow longitudinal ribs arranged side by side along one of the opposite sides of the backing panel. Each longitudinal rib includes a pair of longitudinally extending opposed side walls interconnected by a longitudinally extending bridging wall to form a hollow structure having an essentially U-shaped cross section. The cutting step comprises cutting a slot in the bridging wall of each longitudinal rib. When the cutting is completed, the resultant slot extends along each longitudinal rib such that the longitudinal ribs are converted into the tracks. Stated differently, the cutting step results in a pair of spaced parallel rails created out of the bridging wall to receive therebetween the top portions of the articles. In a preferred forming step, a plastic is blow-molded into the unitary structure.

The present invention further provides a merchandising device which comprises the above display shelf and a support structure for supporting the display shelf above a floor. The support structure is separate from the shelf of the unitary structure. The support structure may support the shelf in a tilted fashion such that the tracks of the shelf are inclined downwardly toward the front ends. When shelf is inclined, it is preferred that a stopper is provided at the front end of each track. Such a stopper engages the leading article in the row to prevent the leading article from exiting the front end of the track until its removal is desired.

Alternatively, the shelf is supported substantially horizontally by the support structure.

The objects and advantages of the present invention will be apparent from the following description, the accompanying drawings and the appended claims.

BRIEF DESCRIPTION OF THE DRAWINGS

In the drawings,

FIG. 4 is a view taken along the line IV—IV of FIG. 3, showing in the dotted lines bottles suspended from the display shelf;

FIG. 5 is a view taken along the line V—V of FIG. 3;

FIG. 6 is an enlarged perspective view of the front portion of one of the tracks in FIG. 1;

DETAILED DESCRIPTION OF THE PREFERRED EMBODIMENTS

Figure 1:
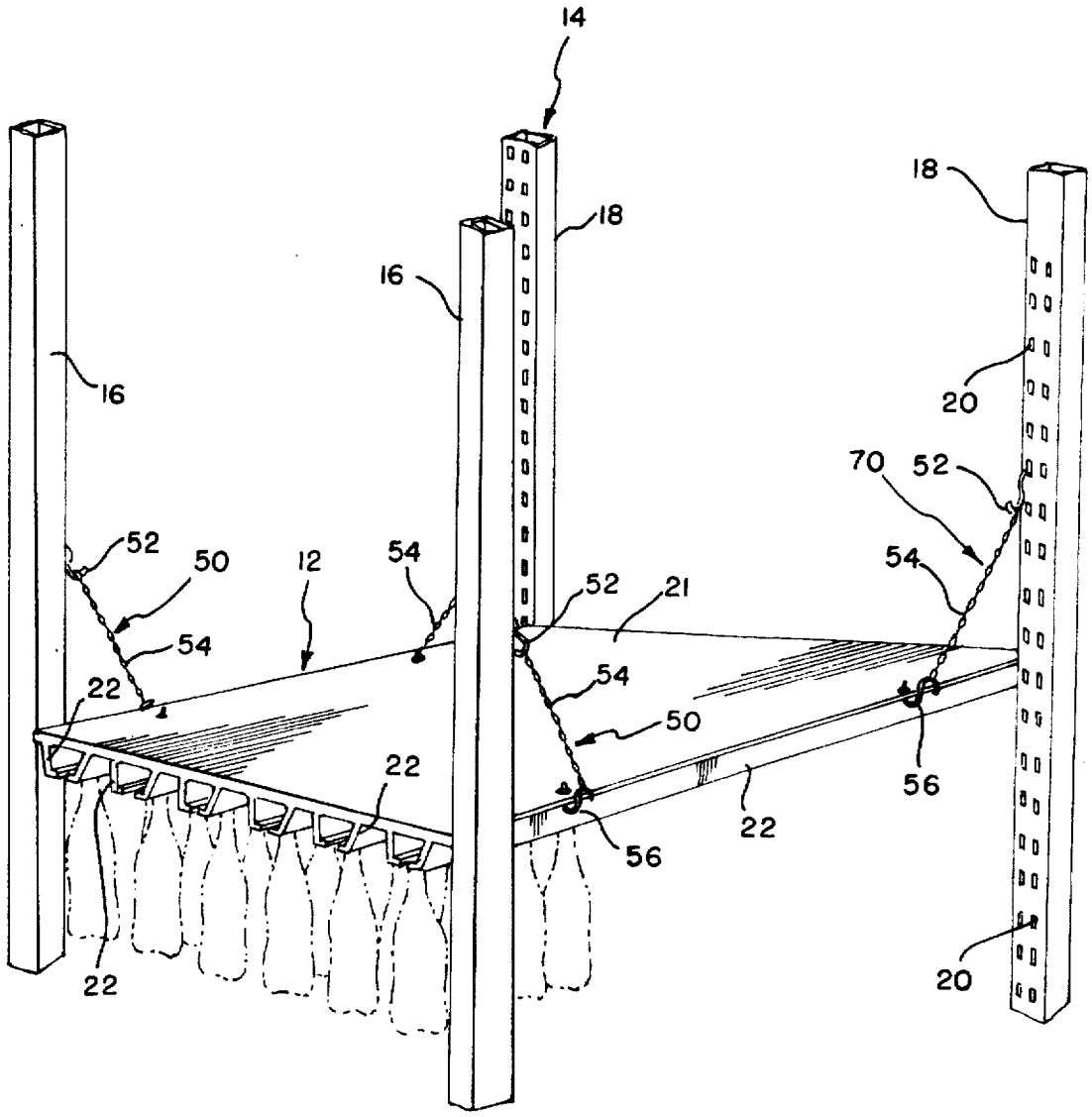
FIG. 1 is a perspective view of a merchandising device according to the invention, showing in the dotted lines bottles suspended from a display shelf.

FIG. 1 illustrates a merchandising device according to the invention. The illustrated device is a gravity feed device designed for dispensing bottles. The device includes one or more bottle display shelves 12 of the kind as shown in FIG. 1 removably mounted on a support structure 14. The structure 14 includes a support frame that is a conventional four-post rack having a pair of front uprights 16 and a pair of rear uprights 18. The device may have only one display shelf 12. However, it will in general have two or more display shelves 12 disposed in a tiered relationship.

The front and rear uprights 16 and 18 are interconnected by suitable transverse members (not shown) to form the support frame of a rigid construction. The four uprights 16 and 18 are of a substantially identical structure having a number of engaging means arranged vertically along themselves. More particularly, each upright is of a rectangular tube structure having the engaging means in the form of two vertical rows of slots 20. The front uprights 16 have the slots 20 formed in their respective rear walls whereas the rear uprights 18 have them in their respective front walls. However, one vertical row of slots in each upright may be sufficient in most of the cases wherein the uprights are used as vertical support members for display shelves.

The display shelf 12 includes a flat rectangular backing panel 21 and a plurality of parallel tracks 22 arranged side by side along the lower side of the backing panel 21. The tracks 22 have their front ends disposed between the front uprights 16 and extend backward from the front ends. The tracks 22 are integrally formed with the backing panel 21. More specifically, as shown best in FIGS. 4 and 6, each track 22 has a pair of longitudinally extending opposed side walls 30 and 32 joined along their upper edges to the backing panel 21. A pair of parallel rails 36 and 38 are joined respectively to the side walls 30 and 32 along their lower edges. A space is maintained between the rails 36 and 38 to receive the necks of flanged bottles. The distance between the rails 36 and 38 is such that when bottle necks are received between the rails 36 and 38, the bottles are automatically arranged in a row and the undersides of the neck flanges engage the rails 36 and 38 to allow the bottles to be suspended for sliding movement along the respective track 22. When the tracks 22 are supported to incline to the front ends, the suspended bottles gravity feed one after another to the front end of each track 22 as the leading bottles on that track successively are removed from the track 22 through the front end.

Typical flanged bottles used with the device of the invention may be soft drink bottles formed of plastic such as PET and having an integrally formed outwardly projecting annular flanges at their necks immediately under their caps. The bottles suspended from the tracks 22 are shown in dotted lines in FIGS. 1 and 5. The detailed manner in which the bottles are suspended by their neck flanges is described in U.S. patent application Ser. No. 08/389,379, owned by the assignee of the present application, which is hereby incorporated by reference.

Figure 3:
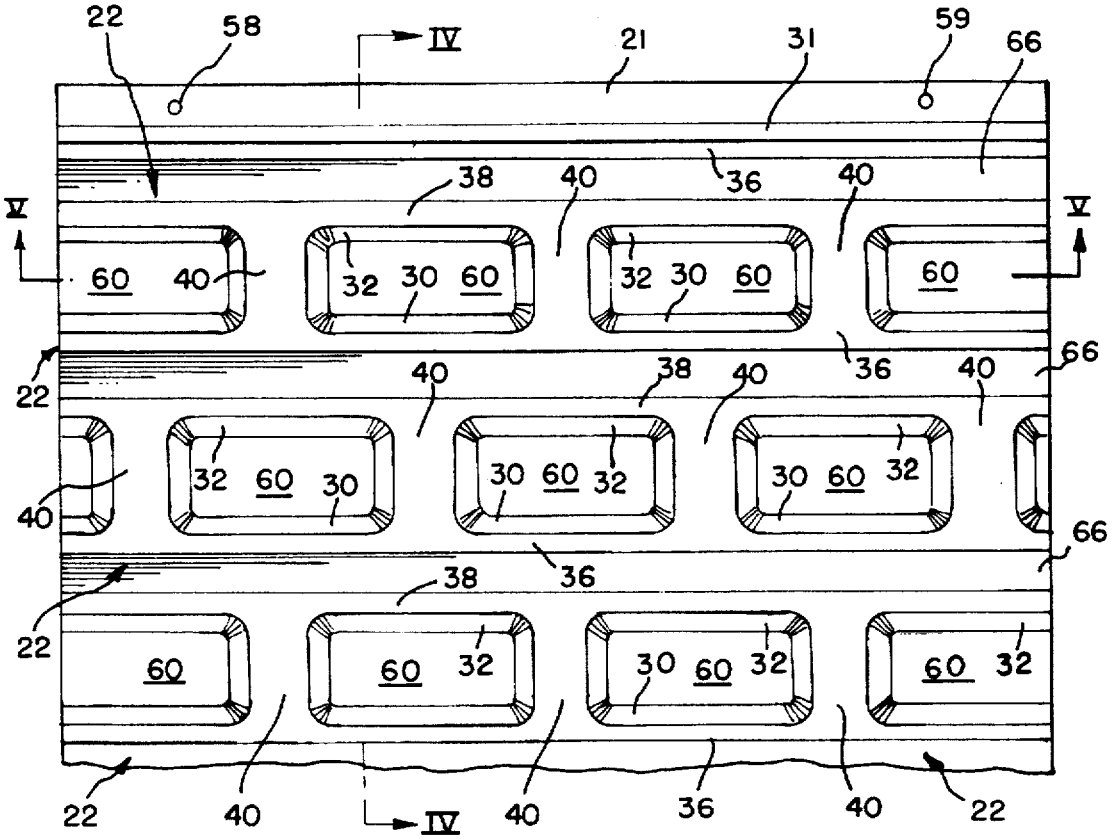
FIG. 3 is a fragmentary bottom view of the display shelf in FIG. 1.

As shown in FIGS. 3–5, the display shelf 12 is provided with a plurality of short transverse ribs 40 formed integrally with the backing panel 21. These transverse ribs 40 are disposed on the lower side of the backing panel 21 such that each rib 40 extends between a pair of adjacent tracks to interconnect the adjacent tracks 22. As viewed in FIG. 3, the transverse ribs 40 are arranged in a staggered fashion to enhance the structural strength of the shelf 12. More specifically, three ribs 40 are formed between the end track (i.e., the uppermost track in FIG. 3) 22 and the second end track 22 while there are four ribs 40 between the second and third end tracks 22. Between the third and fourth end tracks, there are three ribs 40 again. The ribs 40 between the first and second end tracks are positioned in registry with the ribs 40 between the third and fourth end tracks 22 while the ribs 40 between the second and third end tracks 22 are out of registry with the other ribs in FIG. 3. Reference numeral 60 designates recesses defined by the surrounding ribs 40 and the tracks 22.

As shown in FIG. 5, each transverse rib 40 comprises a pair of transversely extending opposed front and rear side walls 42 and 44 interconnected by a base wall 46. The base wall 46 of each rib 40 is joined to the lower edges of the associated side walls 42 and 44 to bridge between the side walls 42 and 44. A hollow 48 is defined within each transverse rib 40 by the associated side and base walls 42, 44 and 46. These hollows 48 of the ribs 40 are in fluid communication with each other through the paths of the tracks 22. The path of each track 22 is defined between the associated side walls 30 and 32 so that the bottles suspended from that track 22 are allowed to move therealong. This arrangement wherein all the transverse ribs 40 and tracks 22 are in fluid communication allows the shelf to be blow-molded as described later.

Returning to FIG. 1, the display shelf is detachably mounted on the support frame 16 and 18 by means of a pair of front joints 50 and a pair of rear joints 70. These joints 50 and 70 constitute a part of the support structure 14.

Each front joint 50 includes an upper S-hook 52, a chain 54, and a lower S-hook 56. The upper hook 52 is engaged with one of the engaging slots 20 of the associated front upright 16. The chain 54 is connected to the upper hook 52 and extended downward. The lower hook 56 is connected to the lower end of the chain 54 and is engaged with the display shelf 12. To facilitate engagement of the lower hook 56 with the display shelf 12, the backing panel 21 is provided at each side edge thereof with a front opening 58 (shown in FIG. 3) for receiving the lower end of the lower hook 56.

The rear joints 70 are virtually identical in structure to the front joints 50, and thus the parts of the rear joints 70 corresponding to those of the front joints 50 are indicated by the same reference numerals. The backing panel 21 is also provided at each side edge thereof with a rear opening 59 (shown in FIG. 3) for receiving the lower end of the lower hook 56 of the associated rear joint 70.

Figure 2:
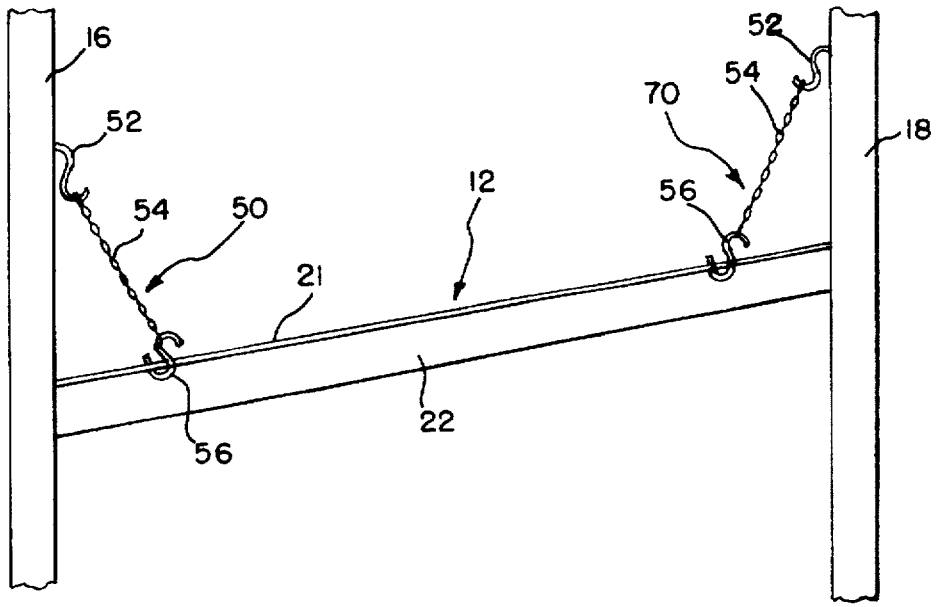
FIG. 2 is a side elevation of the merchandising device in FIG. 1.

The slots 20 of the uprights 16 and 18 with which the upper hooks 52 of the front and rear joints 50 and 70 are engaged are selected such that the front and rear edges of the backing panel 21 are disposed substantially horizontally while the rear edge of the backing panel 21 is supported at the position higher than the front edge of the backing panel 21. This causes the tracks 22 of the shelf 12 to incline to the front ends as best shown in FIG. 2 so that the device of the invention operates as a gravity feed device. Alternatively, the effective lengths of the chains 54 are adjusted to achieve the inclination of the tracks 22. The angle of inclination of the tracks from the horizontal may be about 1 to 20 degrees, preferably about 2 to 18 degrees and most preferably about 7 to 9 degrees.

As shown in FIG. 6, each track 22 is provided at its front end with a front stopper 90 to prevent the leading bottles from exiting the front end of that track until its removal is desired. The stopper 90 comprises a pair of leaf springs 92 (only one shown in FIG. 6) secured at near their upper ends to the outside surfaces of the track side walls 30 and 32 by rivets 94. The leaf springs 92 are provided at their respective lower ends with engaging elements 96 that are loosely and movably received in small apertures formed respectively in the side walls 30 and 32. These engaging elements 96, normally, are extended into the associated track 22 as best shown in FIG. 6. When the leading bottle in each track arrives at the front end of that track 22, it abuts the engaging elements 96 and is thereby prevented from accidentally exiting through the front end. However, when such a leading bottle is pulled forward by for example a customer, the engaging elements 96 are thrust aside into the small apertures in the side walls 30 and 32 and allow removal of the leading bottle. The engaging elements 96 are urged by the springs 92 inwardly of the associated track 22 and thus after removal of the leading bottle, they are brought back to their normal positions to be ready to engage the next leading bottle.

Each track 22 may additionally be provided at its rear end with a rear stopper. The details of such a rear stopper is described in U.S. patent application Ser. No. 08/684,357, owned by the assignee of the present application, which is hereby incorporated by reference.

The display shelf of the invention is formed of moldable material such as metal or plastic. Examples of the metal useful in the present invention include aluminum and aluminum compound such as anodized aluminum. However, thermoplastic resins are preferred to form the display shelf of the invention. Examples of the thermoplastic resins useful in the invention include ABS, polyacetal, poly(acrylic acid), acetylcellulose, cellulose butyrate, cellulose propionate, ionomer, poly(hexamethyleneadipamide), polyphenylene oxide, polycarbonate, polyester, polyethylene, PET, polypropylene, polystyrene, poly(vinyl chloride), SAN, etc. The above described display shelf 12 is formed of plastic in the following manner.

Figure 7:
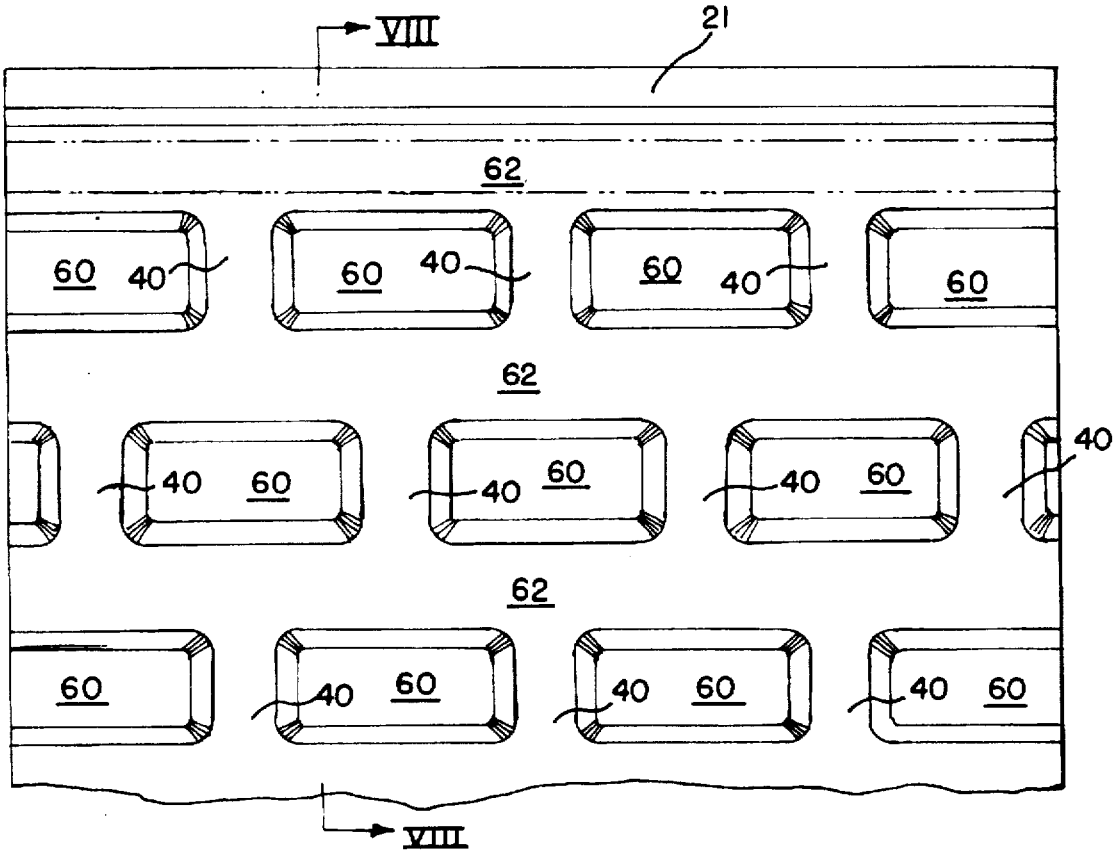
FIG. 7 is a fragmentary bottom view of a unitary structure formed after the forming step but before the cutting step.
Figure 8:
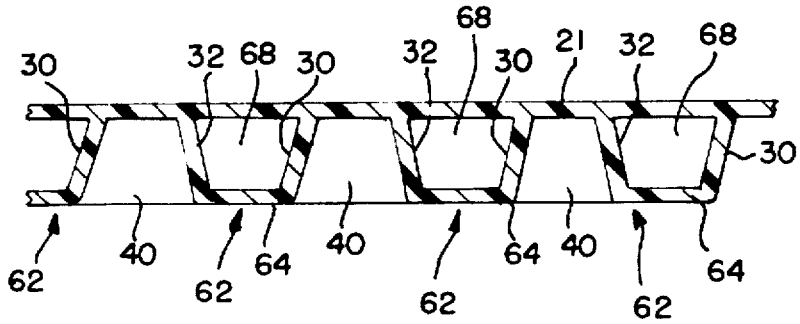
FIG. 8 is a view taken along the line VIII—VIII of FIG. 7.

First, a plastic is blow-molded into a unitary structure. Such a structure is shown in FIG. 7 wherein the structure comprises the backing panel 21 and a plurality of parallel hollow longitudinal ribs 62 arranged side by side along one of the opposite sides of the backing panel 21. A plurality of transverse ribs 40 are also disposed along the one side of the backing panel 21 transversely of the longitudinal ribs 62 such that each transverse rib 40 extends between a pair of adjacent longitudinal ribs 62. As shown in FIG. 8, each longitudinal rib 62 includes a pair of longitudinally extending opposed side walls 30 and 32 interconnected by a longitudinally extending bridging wall 64. These side and bridging walls 30, 32 and 64 of each longitudinal rib 62 in combination form a hollow structure having an essentially U-shaped cross section. Because the unitary structure is blow-molded, the hollows 68 of the longitudinal ribs 62 are in fluid communication with the hollows 48 of the transverse ribs 40.

Subsequently to the blow-molding step, a slot 66 (shown in FIGS. 3 and 4) is cut in the bridging wall 64 of each longitudinal rib 62 to remove that portion of the bridging wall 64 between the phantom lines in FIG. 7. Such a cutting step may be achieved by using any suitable cutting tools such as routers, wide-cut saws, heat-cutting tools, matched die punches, lasers or milling machines. The resultant slots 66 extend all the way along the lengths of the longitudinal ribs 62. By the cutting of such slots 66, the spaced parallel rails 36 and 38 are created out of the bridging wall 64 of each longitudinal rib 62. This converts the longitudinal ribs 62 into the tracks 22, and thereby the display shelf is completed.

Figure 9:
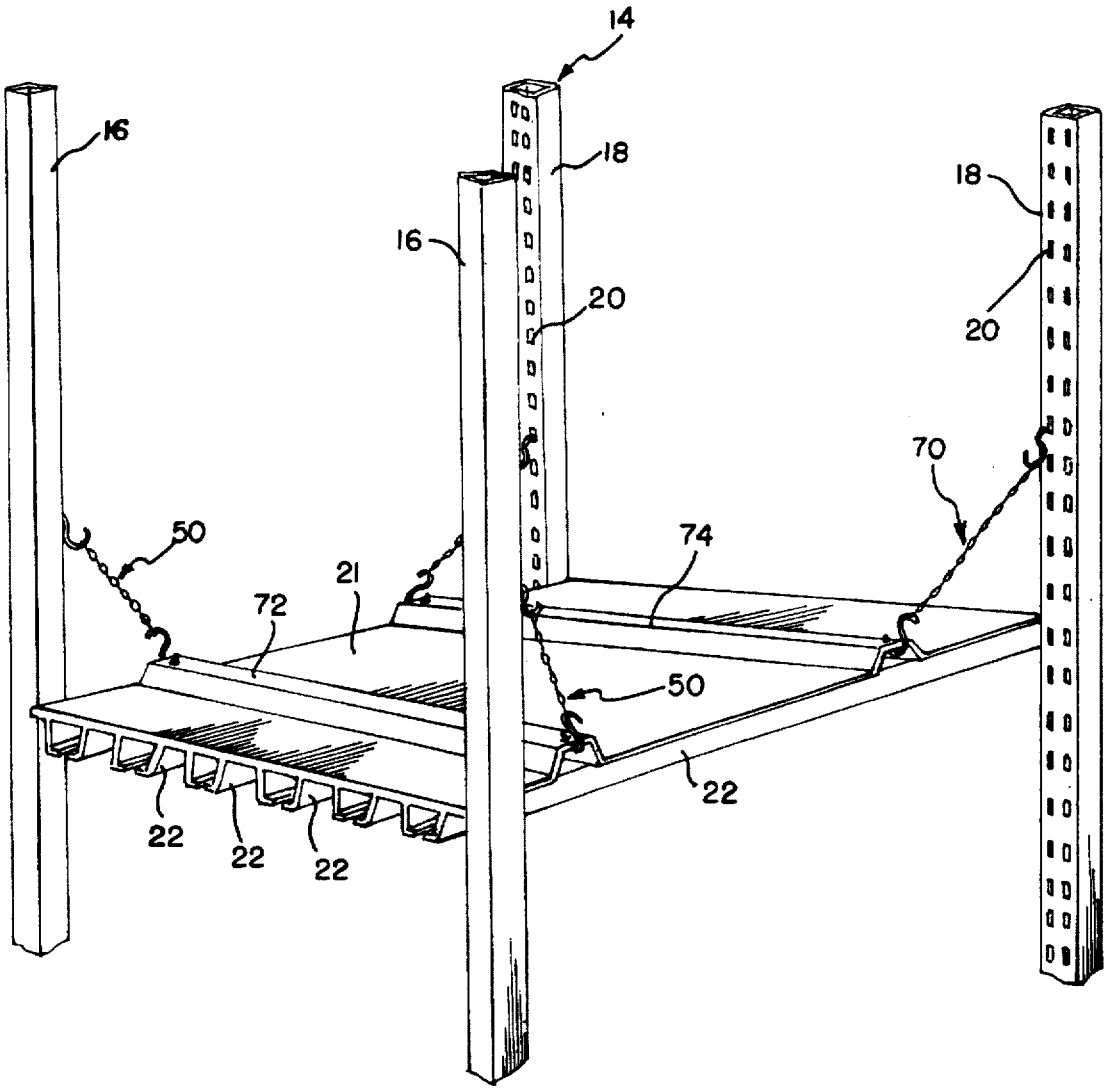
FIG. 9 is a perspective view of a merchandising device of a second embodiment according to the invention.

FIG. 9 illustrates a second embodiment of the merchandising device according to the invention. This device is virtually identical to the device in FIG. 1, and thus like reference numerals are used to indicate the corresponding portions. The device of this embodiment differs from that of FIG. 1 because of a pair of front and rear transverse ridges 72 and 74 formed on the display shelf. These transverse ridges 72 and 74 extend all the way transversely across the upper side of the backing panel 21 to better rigidify the shelf. The ridges 72 and 74 are of a hollow construction and integrally formed with the backing panel 21 as a part of the unitary structure.

Figure 10:
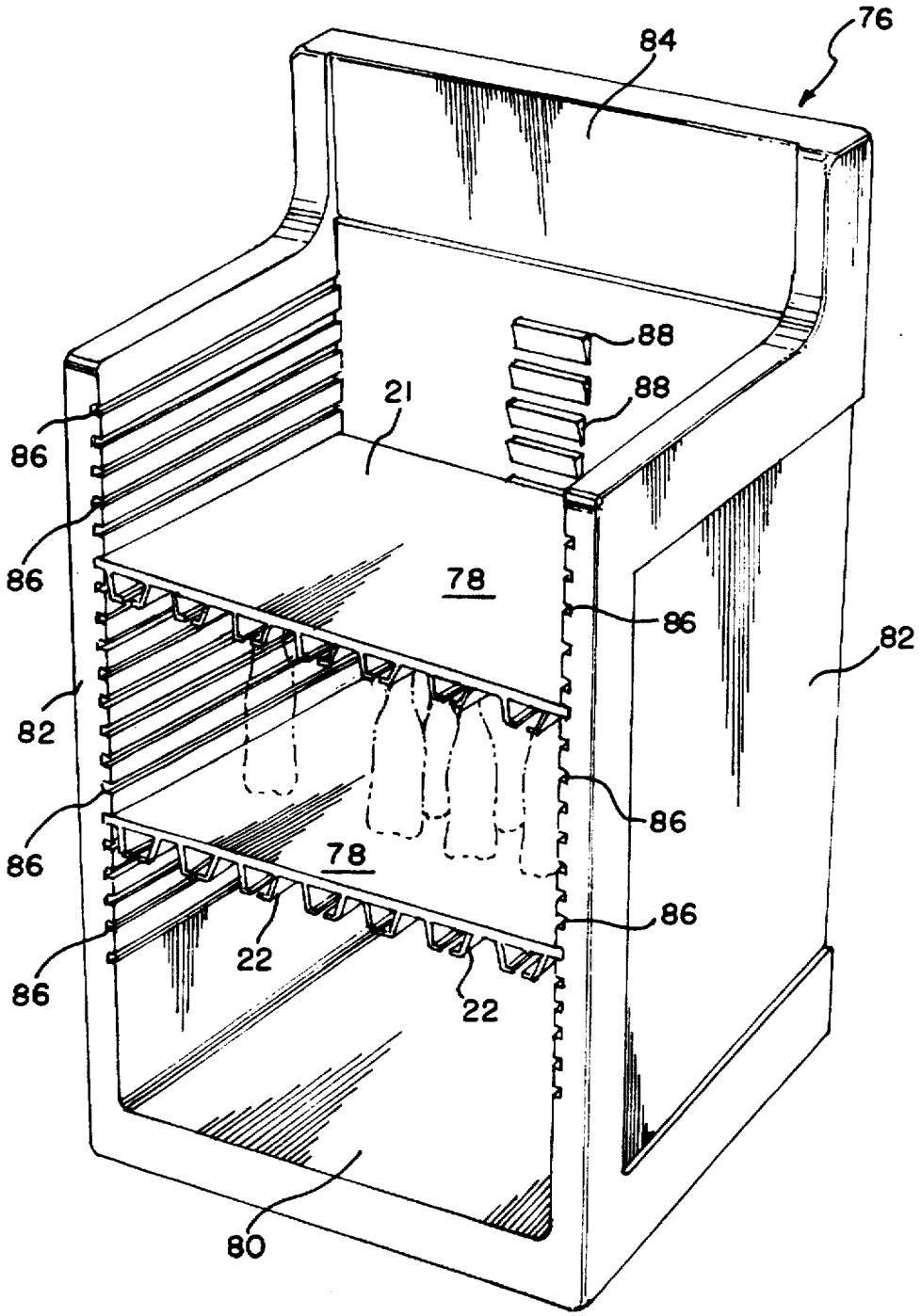
FIG. 10 is a perspective view of a merchandising device of a third embodiment according to the invention.

FIG. 10 illustrates a third embodiment of the merchandising device according to the invention. In this embodiment, a different support structure 76 is employed in place of the four post structure 14 in the first and second embodiments. Each display shelf 78 in this embodiment is virtually identical to the shelf 12 in FIG. 1. The support structure 76 is a unitary plastic body of a rotation- or blow-molded construction which comprises a base 80, a pair of side walls 82 and a back 84. The inside surfaces of the side walls 82 are formed with channel-shaped horizontal grooves 86. The grooves 86 in each side wall 82 are vertically arranged at equal spacings. Each shelf 78 is inserted between the side walls 82 such that the opposite side edges of the backing panel 21 are slidably received in a pair of opposed grooves 86 at the same elevation. The shelf 78 is slid in until its rear reaches the back 84 of the body 76. The rear edge of the backing panel 21 may be extended slightly backwards beyond the rear ends of the tracks 22 and may rest on one of the protrusions 88 on the back 84. Each shelf 78 and/or the body 76 may be provided with suitable means for retaining the shelf 78 in the associated grooves 86 so that the shelf 78 is not easily dislodged from the body 76. The details of the molded body 76 is described in U.S. Pat. No. 5,394,997 which is hereby incorporated by reference.

It will be recognized that many variations may be made to the foregoing within the scope of the present invention. For example, the backing panel may be of a corrugated construction having a number of parallel ridges extending transversely of the tracks 22, the transverse ribs 40 may be omitted particularly when the shelf is properly reinforced by the ridges on the backing panel, and the unitary structure may be injection-molded instead of being blow-molded.

It should be further recognized that the merchandising device and the display shelf of the invention are capable of supporting not only bottles but also stemware such as wine glasses, goblets or the like.

What is claimed is:

1. A display shelf comprising:

a backing panel having upper and lower opposite sides;

a plurality of elongate parallel tracks arranged side by side along said lower side of said backing panel, each of said tracks being adapted to support a row of articles such that said articles in said row are suspended from said each track for movement along said each track; and a plurality of transverse ribs disposed along said backing panel transversely of said tracks, each of said transverse ribs comprising a pair of downwardly extending opposed side walls joined along upper edges thereof to said backing panel and extending between adjacent ones of said tracks, said backing panel, said tracks and said transverse ribs being molded together as a unitary structure.

2. The display shelf according to claim 1, wherein said each track comprises a pair of opposed side walls extending along said each track, said side walls being joined along upper edges thereof to said backing panel, and a pair of parallel rails joined to said side walls along lower edges thereof so as to engage top portions of said articles.

3. The display shelf according to claim 2, wherein a space is maintained between said rails of said each track to receive therein said top portions of said articles.

4. The display shelf according to claim 1, wherein said each transverse rib further comprises a base wall interconnecting a respective pair of said side walls so that a hollow is defined within said each transverse rib by said side and base walls of said each transverse rib.

5. The display shelf according to claim 1, further comprising a support structure for supporting said unitary structure above a floor, said support structure being separate from said unitary structure.

6. The display shelf according to claim 5, wherein said support structure supports said unitary structure in a tilted fashion such that said tracks are inclined downwardly toward front ends of said tracks whereby said articles when supported by said each track are allowed to gravity feed along said each track toward said front end of said each track.

7. The display shelf according to claim 6, further comprising a stopper provided at said front end of said each track for engagement with a leading article in said row to prevent said leading article from exiting said front end of said each track until removal thereof is desired.

8. The display shelf according to claim 7, wherein said stopper comprises an engaging element disposed at said front end of said each track for movement transversely of said each track, and a spring for urging said engaging element inwardly of said each track whereby said article is stopped upon arrival at said front end of said each track.

9. A display shelf comprising:

a backing panel having upper and lower opposite sides;

a plurality of elongate parallel tracks arranged side by side along said lower side of said backing panel, each of said tracks being adapted to support a row of articles such that said articles in said row are suspended from said each track for movement along said each track, said backing panel and said tracks being molded together as a unitary structure, said each track comprising a pair of opposed side walls extending along said each track and joined along upper edges thereof to said backing panel, and a pair of parallel rails joined to said side walls along lower edges thereof so as to engage top portions of said articles; and a plurality of transverse ribs formed integrally with said backing panel and disposed along said backing panel transversely of said tracks, each of said transverse ribs extending between adjacent ones of said tracks, wherein said each transverse rib comprises a pair of transversely extending opposed side walls interconnected by a base wall so that a hollow is defined within said each transverse rib by said side and base walls of said each transverse rib.

10. The display shelf according to claim 9, wherein a path is defined between said side walls of said each track for said articles in said row to move therealong, and said hollows of said transverse ribs are in fluid communication with each other through said paths of said tracks.

11. A display shelf comprising:

a backing panel having upper and lower opposite sides;

a plurality of elongate parallel tracks arranged side by side along said lower side of said backing panel, each of said tracks being adapted to support a row of articles such that said articles in said row are suspended from said each track for movement along said each track, said backing panel and said tracks being molded together as a unitary structure, said each track comprising a pair of opposed side walls extending along said each track and joined along upper edges thereof to said backing panel, and a pair of parallel rails joined to said side walls along lower edges thereof so as to engage top portions of said articles; and a plurality of transverse ribs formed integrally with said backing panel and disposed along said backing panel transversely of said tracks, each of said transverse ribs extending between adjacent ones of said tracks, wherein said transverse ribs are arranged on said lower side of said backing panel in a staggered fashion.

12. A display shelf comprising:

a backing panel having upper and lower opposite sides;

a plurality of elongate parallel tracks arranged side by side along said lower side of said backing panel, each of said tracks being adapted to support a row of articles such that said articles in said row are suspended from said each track for movement along said each track; and a plurality of transverse ribs disposed along said backing panel transversely of said tracks, each of said transverse ribs extending between adjacent ones of said tracks, said transverse ribs being arranged on said lower side of said backing panel in a staggered fashion, wherein said backing panel and said tracks are molded together as a unitary structure.

13. The display shelf according to claim 12, wherein said each transverse rib comprises a pair of transversely extending opposed side walls interconnected by a base wall so that a hollow is defined within said each transverse rib by said side and base walls of said each transverse rib.

14. The display shelf according to claim 13, wherein said each track comprises a pair of opposed side walls extending along said each track, said side walls being joined along upper edges thereof to said backing panel, and a pair of parallel rails joined to said side walls along lower edges thereof so as to engage top portions of said articles.

15. The display shelf according to claim 14, wherein a path is defined between said side walls of said each track for said articles in said row to move therealong, and said hollows of said transverse ribs are in fluid communication with each other through said paths of said tracks.

* * * * *